US009458695B2

(12) United States Patent
Hallundbæk

(10) Patent No.: US 9,458,695 B2
(45) Date of Patent: Oct. 4, 2016

(54) DOWNHOLE PRESSURE COMPENSATING DEVICE

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 520 days.

(21) Appl. No.: 14/007,658

(22) PCT Filed: Mar. 29, 2012

(86) PCT No.: PCT/EP2012/055632

§ 371 (c)(1),
(2), (4) Date: Sep. 26, 2013

(87) PCT Pub. No.: WO2012/130936

PCT Pub. Date: Oct. 4, 2012

(65) Prior Publication Data

US 2014/0014352 A1 Jan. 16, 2014

(30) Foreign Application Priority Data

Mar. 30, 2011 (EP) ..... 11160490

(51) Int. Cl.
*E21B 34/08* (2006.01)
*E21B 43/119* (2006.01)
*E21B 47/01* (2012.01)

(52) U.S. Cl.
CPC ..... *E21B 34/08* (2013.01); *E21B 43/1195* (2013.01); *E21B 47/011* (2013.01)

(58) Field of Classification Search
CPC ..... E21B 34/00; E21B 34/06; E21B 34/08; E21B 43/1195; E21B 47/071
See application file for complete search history.

(56) References Cited

U.S. PATENT DOCUMENTS 2,647,583 A * 8/1953 Kriegel ..... E21B 34/06 166/146
3,974,876 A 8/1976 Taylor
(Continued)

FOREIGN PATENT DOCUMENTS

CA 2591317 A1 12/2007
CA 2594925 A1 6/2008
(Continued)

OTHER PUBLICATIONS

International Preliminary Report on Patentability issued in International Patent Application No. PCT/EP2012/055632 mailed on Oct. 10, 2013.
(Continued)

*Primary Examiner* — Yong-Suk (Philip) Ro
(74) *Attorney, Agent, or Firm* — Nixon & Vanderhye P.C.

(57) ABSTRACT

A downhole pressure compensating device includes a housing with a chamber and an internal hollow section, a first piston dividing the chamber into a first section and a second section, the first section being in fluid communication with a first fluid port, the second section being in fluid communication with a borehole through a second fluid port, and a first spring disposed within the second section to exert a pressure on the first piston to enable the conservation of an overpressure in the first section. Furthermore, the device includes second piston, a second spring disposed between the first piston and the second piston, and an overpressure channel arranged in the first or the second piston, which overpressure channel, when the second spring is in a compressed condition, provides fluid communication between said first and second sections.

19 Claims, 15 Drawing Sheets

(56) References Cited

U.S. PATENT DOCUMENTS

| | | | | |
|---|---|---|---|---|
| 4,799,546 | A * | 1/1989 | Hensley | E21B 17/003 166/254.2 |
| 2002/0189815 | A1* | 12/2002 | Johnson | E21B 34/08 166/373 |
| 2010/0032155 | A1 | 2/2010 | Darnell | |
| 2011/0083859 | A1* | 4/2011 | Scranton | E21B 34/10 166/374 |
| 2011/0198097 | A1* | 8/2011 | Moen | E21B 34/08 166/373 |
| 2012/0067594 | A1* | 3/2012 | Noske | E21B 34/08 166/373 |
| 2012/0327742 | A1* | 12/2012 | Kusko | G01V 1/137 367/25 |
| 2013/0068467 | A1* | 3/2013 | Zhou | E21B 34/08 166/369 |

FOREIGN PATENT DOCUMENTS

| | | | |
|---|---|---|---|
| CN | 2398442 | Y | 9/2000 |
| RU | 2341639 | C2 | 12/2008 |
| RU | 2354827 | C2 | 5/2009 |
| RU | 2383729 | C2 | 3/2010 |
| WO | 2009/014932 | A2 | 1/2009 |

OTHER PUBLICATIONS

International Search Report for PCT/EP2012/055632, mailed Apr. 27, 2012.

Written Opinion for PCT/EP2012/055632, mailed Apr. 27, 2012.

Office Action dated Aug. 17, 2015 issued in Chinese Application No. 201280017079.8 (5 pages).

Decision to Grant dated Mar. 23, 2016 issued in Russian Application No. 2013147497/03 (9 pages).

* cited by examiner

DOWNHOLE PRESSURE COMPENSATING DEVICE

This application is the U.S. national phase of International Application No. PCT/EP2012/055632 filed 29 Mar. 2012 which designated the U.S. and claims priority to EP Patent Application No. 11160490.6 filed 30 Mar. 2011, the entire contents of each of which are hereby incorporated by reference.

FIELD OF THE INVENTION

The present invention relates to a pressure compensating device used for pressure equalisation in downhole well tools to avoid implosions or explosions of the tools.

BACKGROUND ART

Downhole tools such as driving units, strokers, perforators etc. are exposed to extreme pressure differences between the inside and outside of the tools. In order to avoid collapses by implosion or explosion of the tools, which might damage both tools and well structure and furthermore lead to production stops in the wells, pressure compensating devices have been well-known for decades within this field. To accommodate pressure compensation, borehole fluid is typically allowed inside the tool on one side of the pressure compensating device and hydraulic fluids typically maintained inside a downhole tool will be on the other side, thereby equalising the two pressures on each side of the pressure compensating device.

A variety of pressure compensating devices are known using rubber bags, diaphragms, bellows and springs in the pressure compensating mechanism. However, they suffer from being designed to withstand a certain pressure difference, which when exceeded leads to a breakdown of the mechanism.

Increased reliability and a more fail-safe mechanism of a pressure compensating device for use in boreholes would therefore lead to optimised drilling and production performance, thereby minimising costs and maximising return of well operations. Since several types of tools require pressure compensation during borehole operations, various different processes would benefit from an improved pressure compensating device, all leading to a minimised risk of limitation in production time.

Thus, there is a need to be able to compensate pressures in downhole tools during exploration, production and monitoring of subsurface deposits, such as oil and gas deposits.

SUMMARY OF THE INVENTION

It is an object of the present invention to wholly or partly overcome the above disadvantages and drawbacks of the prior art. More specifically, it is an object to provide an improved system for compensating pressures in downhole tools during exploration, production and monitoring of subsurface deposits, such as oil and gas deposits.

The above objects, together with numerous other objects, advantages, and features, which will become evident from the below description, are accomplished by a solution in accordance with the present invention by a downhole pressure compensating device for use in combination with a downhole tool, comprising:

a housing with a chamber and an internal hollow section, a first piston dividing the chamber into a first section and a second section, the first section being in fluid communication with a first fluid port, the second section being in fluid communication with a borehole through a second fluid port, and a first spring disposed within the second section to exert a pressure on the first piston to enable the conservation of an overpressure in the first section, wherein the device further comprises:

a second piston, a second spring disposed between the first piston and the second piston, and an overpressure channel arranged in the first or the second piston, which overpressure channel, when the second spring is in a compressed condition, provides fluid communication between said first and second sections.

In one embodiment, the downhole pressure compensating device may comprise at least a pressure connection to a mating tool in a tool string.

Said mating tool may be a driving unit.

In another embodiment, the second section of the compensating device may be in fluid communication with the inside of an electrical motor unit and/or a hydraulic pump unit.

Moreover, the first spring, the second spring, the first piston and the second piston may be arranged coaxially with the longitudinal centre axis of the compensating device.

Further, the at least one of the first spring, the second spring, the first piston and the second piston may have been arranged non-coaxially with the longitudinal centre axis of the compensating device non-circumscribing the internal hollow section.

The compensating device according to the invention may be arranged non-coaxially with a longitudinal centre axis of the tool.

Additionally, the second piston may be partly arranged inside the first piston.

Also, the first piston may be partly arranged inside the second piston.

In one embodiment, the first section of the chamber may be filled with a pressurised hydraulic fluid such as oil with predetermined characteristics (matching the conditions of the borehole).

Moreover, the first and second springs may be coil springs, helical springs, bellows, volute springs, leaf springs, gas springs or disc springs.

The downhole pressure compensating device according to the invention may further comprise electrical sensors for monitoring a temperature inside the device and/or pressures in the first and second sections and/or positions of the first and second pistons for producing a feedback signal to a control system.

Said downhole pressure compensating device may further comprise at least a switch wherein the compensating device can be controlled by the at least a switch connected to the control system to adapt to changes in environmental conditions based on the feedback signal.

Furthermore, the device may comprise a plurality of first and/or second springs.

Furthermore, the device may comprise a plurality of spring guides.

Also, the second spring may be arranged within the first piston.

The device may comprise a plurality of first springs arranged concentrically in the housing.

In an embodiment, the second spring may be arranged within the first piston in an overpressure valve, the overpressure valve comprising the second spring and the second piston.

Additionally, the housing may comprise a tubular member and two end members detachably connected.

The present invention furthermore relates to a downhole system comprising:

- a wireline,
- a mating tool such as a driving unit and/or an operational tool, and
- a downhole pressure compensating device according to the invention.

The present invention also relates to a downhole tool system comprising:

- at least a mating tool such as a driving unit and/or an operational tool, and
- a downhole pressure compensating device according to the invention.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
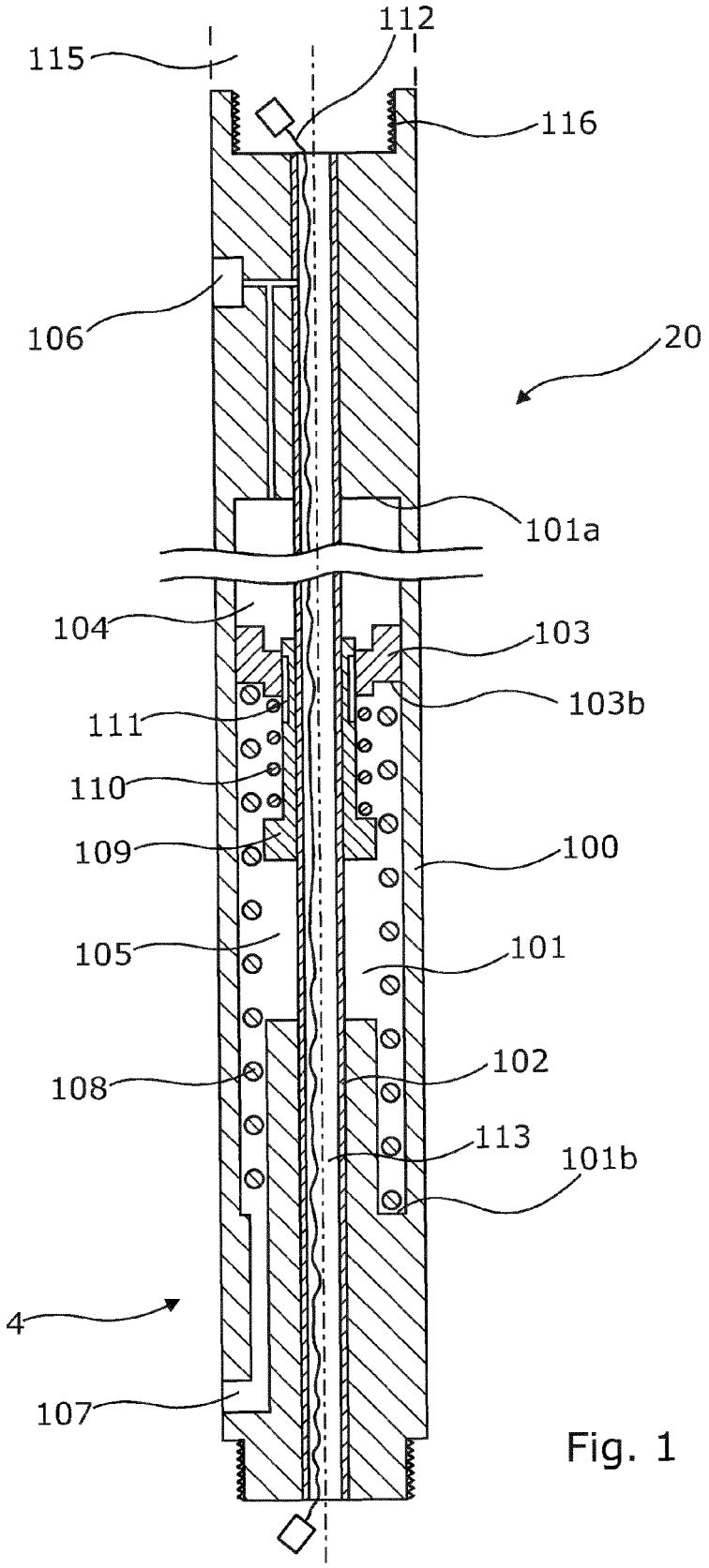
FIG. 1 shows a cut-through view of a pressure compensating device.

FIG. 1 shows a pressure compensating device 20 for compensating pressure differences between the inside and outside of a downhole tool to avoid implosion or explosion of such a tool due to pressure differences. The pressure compensating device 20 is attached to a downhole tool 115 in order to compensate for changes in pressure. The pressure compensating device 20 comprises a housing 100 with a chamber 101 and an internal hollow section 102.

The hollow section 102 may facilitate electrical connections 112 between two tools 115 arranged in each end of the compensating device 20 and connected to the compensating device 20 by connecting means 116. The pressure in the hollow section 102 is regulated by a first piston 103, a second piston 109, a first spring 108 and a second spring 110. An interior of the two tools connected to each end of the compensating device may be in fluid communication with the interior 113 of the hollow section 102 whereby the internal pressure of the two tools may be regulated by the compensating device 20. The first piston 103 and second piston 109 seal the first section 104 from the second section 105 of the chamber 101. When the first spring 108 is arranged between a second end face 101*b* of the chamber and a second face 103*b* of the first piston 103, the first spring 108 thereby applies a force on the second end face 101*b* of the chamber 101 and a second face 103*b* of the first piston 103. The second spring 110 is arranged between the first piston 103 and the second piston 109, the second spring 110 applying a force on the first piston 103 and the second piston 109. An overpressure channel 111 is arranged in the first and/or second piston to provide fluid connection between the first and second sections 104, 105 of the chamber 101, when the first and second pistons 103, 109 are displaced towards their extremum positions in each end of the chamber 101. FIG. 1 shows a compressed state of the first spring 108, and if the first and second pistons 103, 109 are moved further towards the second end face of the chamber 101, the second piston 109 will, when the first spring is compressed to a certain degree, engage the second end face, thereby stopping the movement of the second piston 109 towards the second end face of the chamber 101. When the first piston 103 continues to move towards the second end face, the second spring 110 will start to compress, and at a given point the overpressure fluid channel will then provide access between the first and second sections 104, 105 of the chamber 101, and fluid from the first section 104 of the chamber 101 will start to flow through the overpressure fluid channel entering the second section 105 of the chamber 101.

In FIGS. 2 and 3, the activation of the overpressure channel in both ends of the chamber 101 is shown step by step.

Figure 2A:
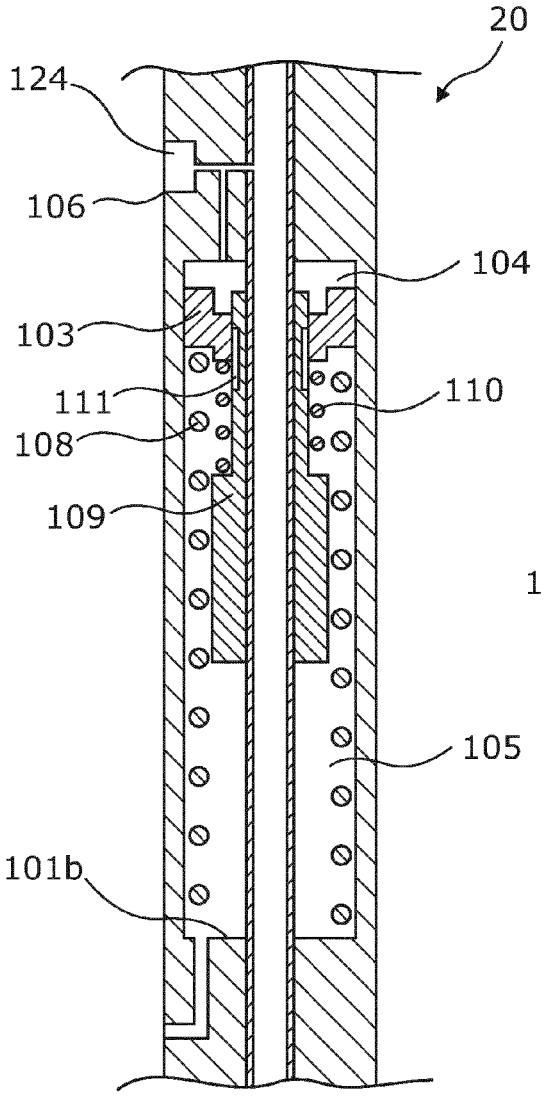
FIGS. 2*a*-2*d* show schematic diagrams of a pressure compensating device during filling of a first section with hydraulic fluid.
Figure 2B:
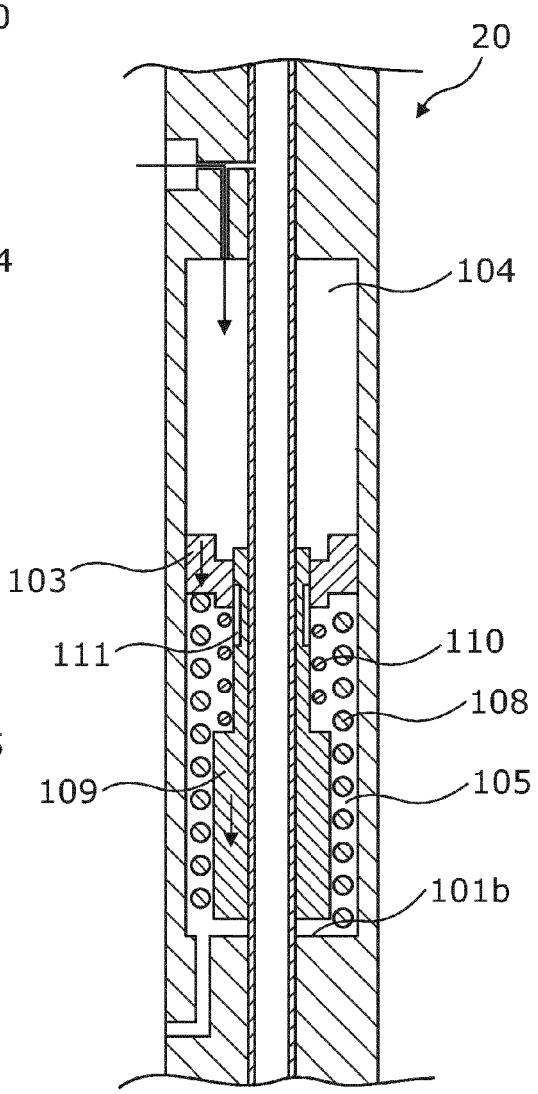
Figure 2C:
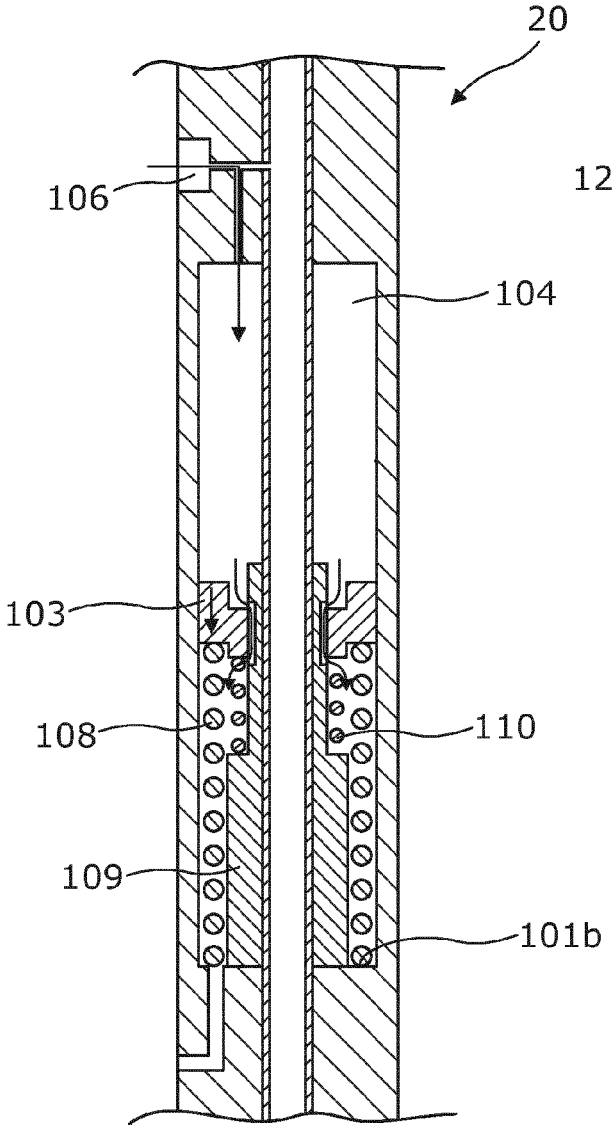
Figure 2D:
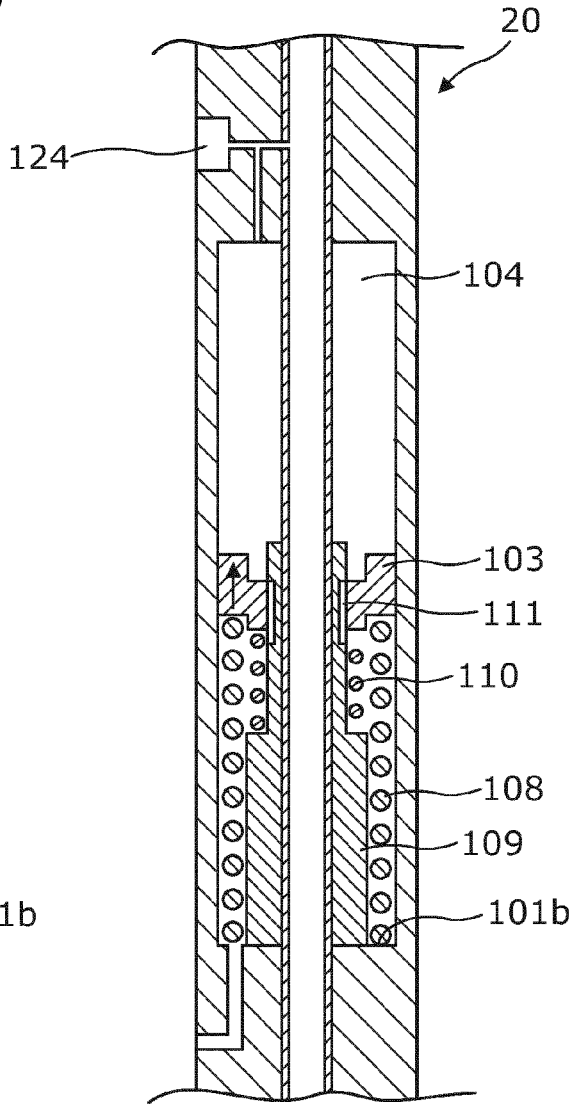

FIGS. 2*a*-*d* show the displacement of the first and second pistons towards the second end face 101*b* due to a pressurisation of the first section 104 of the chamber 101. Prior to lowering the compensating device 20 into a borehole 4, the first section 104 may be filled with fluid by removing a plug 124 from a first fluid port 106 and filling the first section 104 with fluid, whereby the first section 104 will be pressurised. FIG. 2*a* shows the first and second springs 108, 110 in relaxed positions with the first and second pistons 103, 109 displaced towards the first end face 101*a* and the overpressure channel 111 closed. When a pressurising fluid enters the first section 104 through the first fluid port 106, the first spring 108 is compressed as shown in FIG. 2*b*. As can be seen in FIG. 2*b*, the second spring 110 is still uncompressed in this condition and therefore the overpressure channel is still closed, resulting in no fluid connection between the first and second sections 104, 105. If, however, the first section 104 is further pressurised, the second spring 110 will start to compress resulting in movement of the second piston 109, while the first piston 103 has stopped moving, which is seen in FIG. 2*c*. As indicated by an arrow in FIG. 2*c*, the overpressure channel provides fluid communication between the first and second sections 104, 105, when the second piston 109 is displaced beyond a certain point, thereby allowing fluid from the first section 104 to flow into the second section 105, thus relieving the overpressure of the first section 104. In FIG. 2*d*, the first fluid port 106 is closed, thereby stopping inflow of pressurised fluid into the first section 104. When the first fluid port 106 is closed, the second piston 109 will move back towards its relaxed position as fluid exits the first section 104 through the overpressure channel 111. When the second piston 109 reaches a position in relation to the first piston 103, the overpressure fluid channel is once again closed as shown in FIG. 2*d*, and then the second piston 109 will stop moving. This mechanism therefore provides a restriction of the pressure in the first section 104 so it does not exceed a certain maximum pressure. Furthermore, it allows the user to pressurise the first section 104 to a predetermined pressure every time the first section 104 is pressurised before lowering the compensating device 20 into the borehole. The actual spring constants of the first and second springs 108, 110 are chosen to correspond to the predetermined pressure. Thus the predetermined pressure may be controlled by changing springs or preloading springs to a certain degree in order to accommodate special pressure requirements for the compensating device 20 matching special downhole conditions.

Figure 3A:
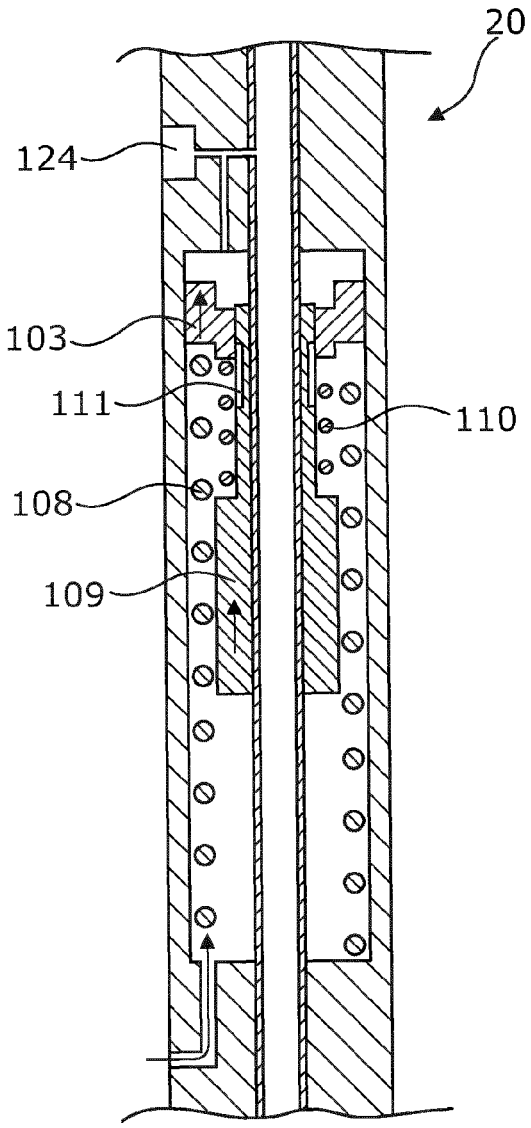
FIGS. 3*a*-3*d* show schematic diagrams of a pressure compensating device during filling of a second section with borehole fluid.
Figure 3B:
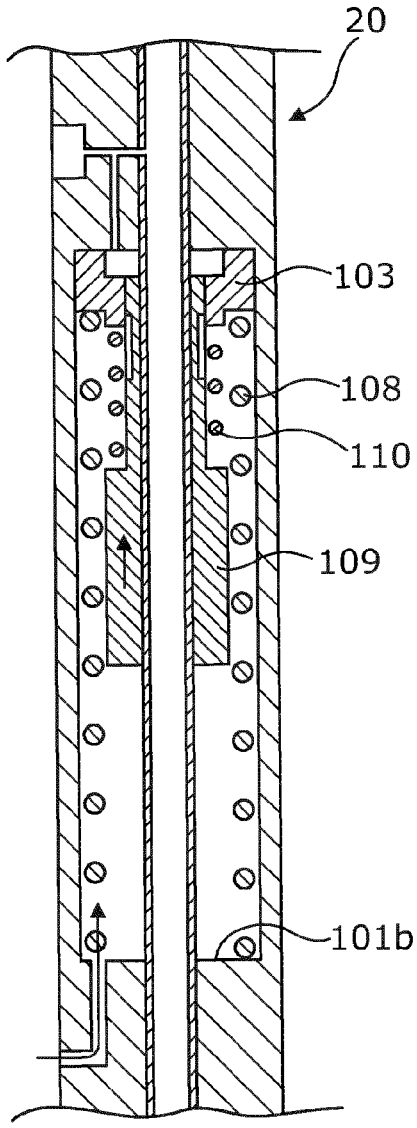
Figure 3C:
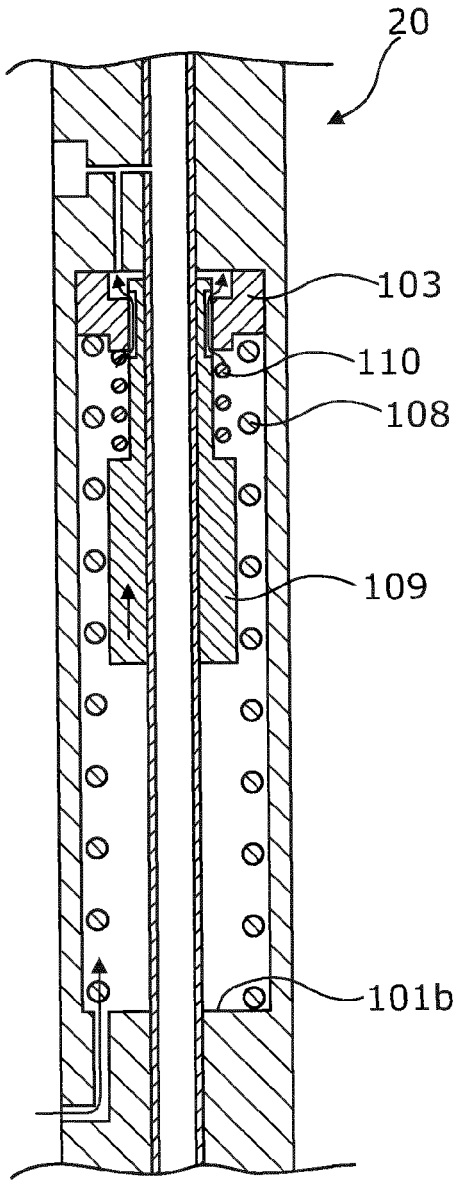

FIGS. 3*a-d* show how the pressure is compensated during a pressure build-up in the borehole. As explained above, the first section 104 is pressurised before lowering the compensating device 20 into the borehole. Therefore, the initial condition of the compensating device 20 when lowered into the borehole is the situation depicted in FIG. 2*d*. When the compensating device then subsequently enters the borehole, the pressure from the borehole is transferred to the second section 105 through the second fluid port 107, and the pressure in the second section 105 increases as the pressure in the borehole increases. In FIG. 3*a*, the borehole pressure has forced the first and second pistons 103, 109 towards the first end face of the chamber 101 decompressing the first spring 108. By this movement of the first piston 103, the pressure is compensated, i.e. the pressure is equalised in the first and second sections of the pressure compensating device 20. Since the first section 104 is in fluid communication with the inside of a tool, the tool will, in this way, be pressure compensated and thereby not destroyed during a pressure build-up in the borehole. The problem is that if the pressure inside the tool becomes much higher or much lower than outside the tool, the tool will either increase or decrease in volume. To avoid this change in volume of the tool, the inside of the tool is connected to a pressure compensating device, so that if the pressure in the borehole, i.e. in the second section 105, becomes much higher than in the tool, which is in fluid communication with the first section 104, the first section 104 may decrease in volume. If on the other hand the pressure in the borehole is much lower than in the tool, the first section 104 may increase in volume. FIG. 3*b* shows the situation in which the first piston has reached its maximum displacement towards the first end face and abuts the first end face due to increasing pressure in the second section 105 stemming from the pressure in the borehole increasing. If the pressure continues to increase in the second section 105 beyond the point demonstrated in FIG. 3*b*, the second piston 109 will begin to move towards the first end face and the second spring 110 will begin to compress. As shown in FIG. 3*c*, the overpressure in the second section 105 opens the fluid connection between the first and second sections 104, 105 when the second piston 109 has moved sufficiently long towards the first end face, which allows fluid from the second section 105 to enter the first section 104. In general, this is an undesirable situation since dirty fluid from the borehole is allowed to enter the inside of the compensating device 20 and thereby the inside of the tool being in fluid communication with the first section 104 of the compensating device 20. However, the alternative may be much worse since the tools may be completely destroyed by implosion if they are unable to compensate the borehole pressure. Furthermore, the deformation caused by such implosion might cause the pressure compensating device and/or tool attached thereto to jam inside the borehole, leading to complete production stop of the well. Therefore, the flooding of the first section 104 of the compensating device 20 and thus the tool with dirty borehole fluid protects both the pressure compensating device and the tool being pressure compensated from collapsing. Therefore, the possibility of allowing borehole fluid inside the first section 104 acts as a fail-safe to the pressure compensating device 20. In case the fail-safe is activated and the hydraulic fluid of the first section 104 is polluted with dirty borehole fluid, both the pressure compensating device 20 and the potentially polluted tool will normally be retracted from the borehole and thoroughly cleaned.

Figure 3D:
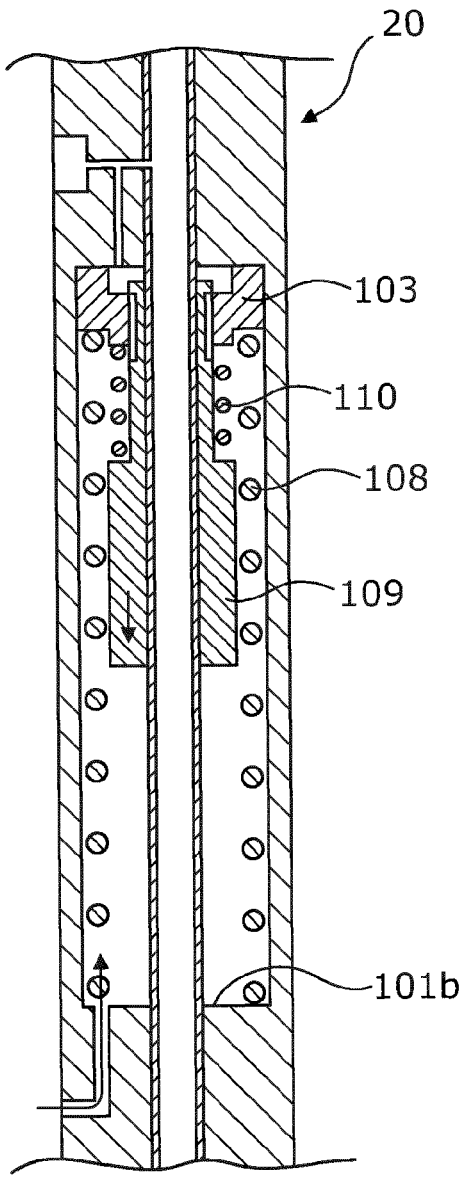

In FIG. 3*d*, the second piston 109 has moved back towards the second end face, thereby closing the overpressure channel after the pressure has been equalised in the first and second sections 104, 105.

The compensating device 20 serves another purpose with respect to compensating the pressure. When the compensating device 20 is lowered into the borehole, the temperature is increasing depending on the depth and the proximity of the borehole to the magma layers. When a volume of the pressurised fluid in the first section 104 increases due to the increase in temperature, the pressure on the first and second pistons 103, 109 increases. In case the pressure exceeds a pressure defined by the first and second springs 108, 110 for opening the overpressure channel, the hydraulic fluid from the first section 104 is released into the second section 105 and into the borehole. Again the compensating device 20 acts as a fail-safe against collapse or bulging of the compensating device and/or the tool attached to the compensating device due to thermal expansion of the hydraulic fluid in the pressure compensating device 20. Conventionally, this problem has been dealt with by only filling prior compensating devices partially to avoid bulging. This prior approach has the following two main drawbacks. The first drawback is that even though the compensating device is only filled partially to avoid bulging due to thermal expansion, it still depends on the temperature being below a critical temperature. This is due to the fact that temperatures may fluctuate locally, e.g. near magma layers, to very high temperatures. Thus, the safety of the compensating device might be compromised even with conservative fillings of the hydraulic fluid in the compensating device so that the tool will bulge anyway if the compensating device cannot withstand the pressure of the thermally expanded hydraulic fluid. The second drawback is that the hydraulic fluid serves the purpose of withstanding the pressure stemming from the borehole pressure which also increases with depth and local conditions in the borehole. By only filling prior compensating devices partially, i.e. decreasing the amount of hydraulic fluid in a compensator, the ability to compensate the pressure in a tool is reduced since less hydraulic fluid is available in the first section. The ability is reduced since the volume of the hydraulic fluid may decrease during pressure compensation through leaks in fluid communication with the first section of the chamber, e.g. through leaks in the tool, which is typically occurring during operation in the well.

Figure 4A:
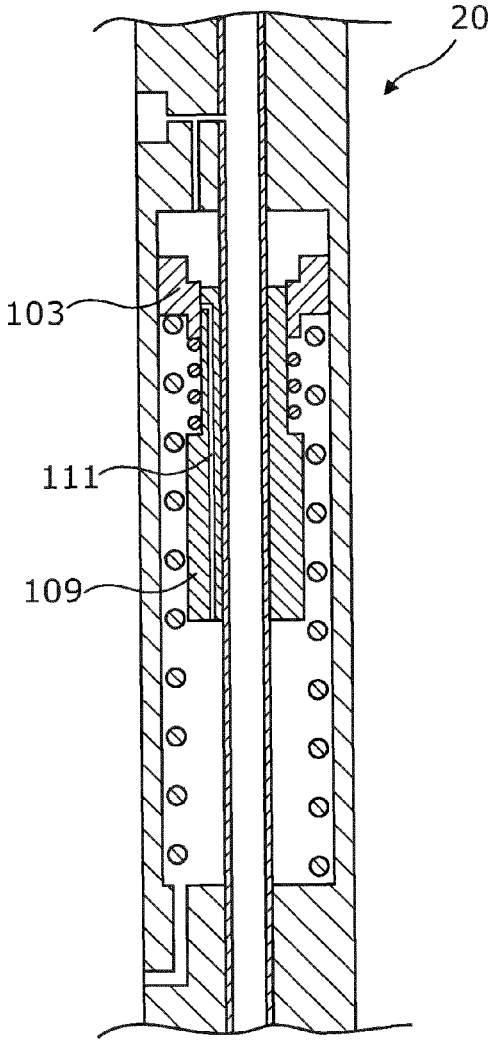
FIGS. 4*a*-4*d* show schematic diagrams of various embodiments of pressure compensating devices.
Figure 4B:
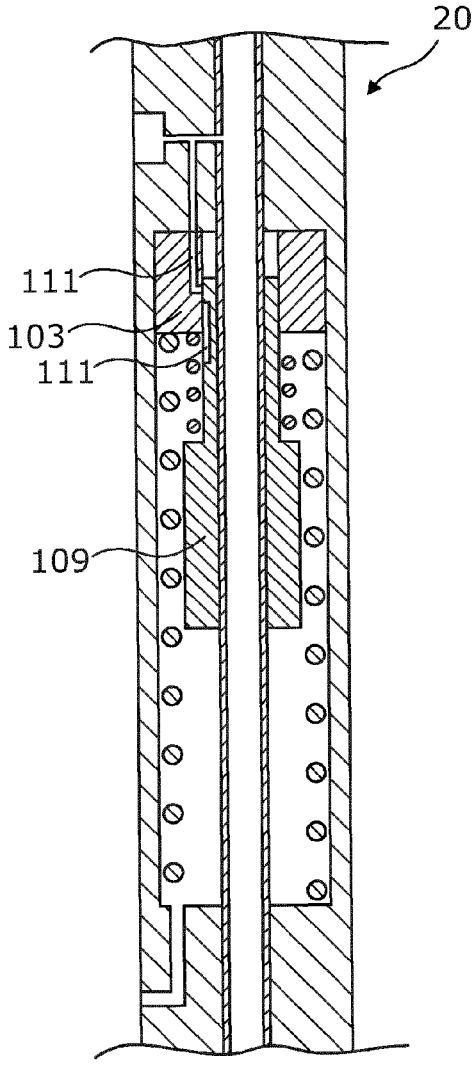
Figure 4C:
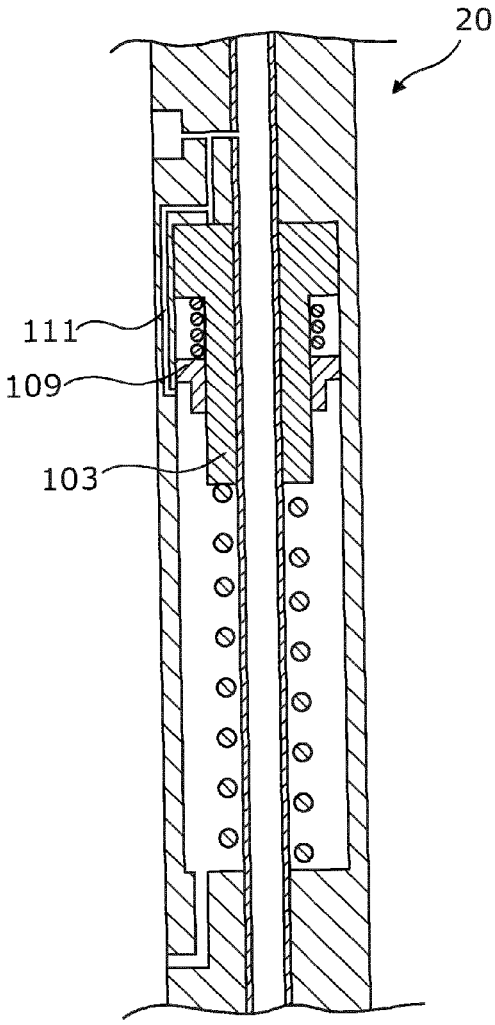
Figure 4D:
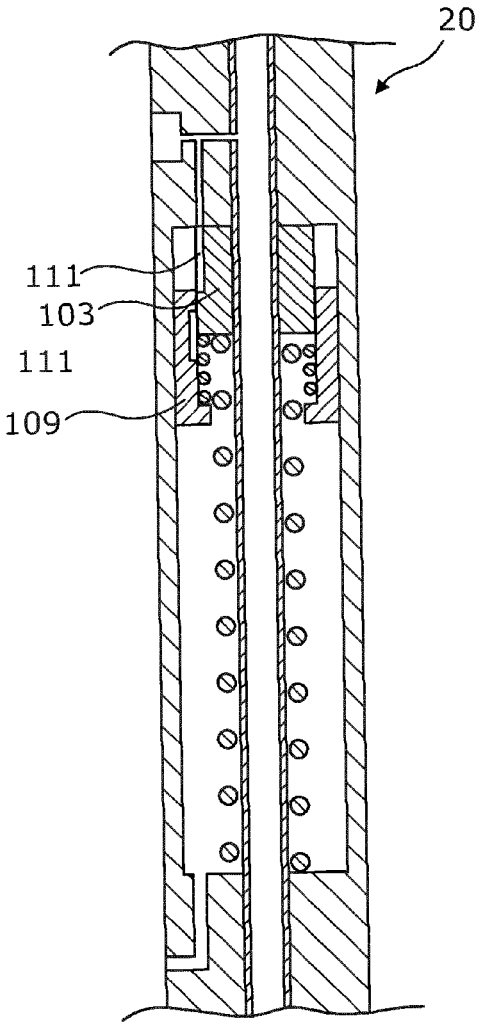

FIGS. 4*a-d* show different embodiments according to the invention. FIG. 4*a* shows a compensating device 20 according to the invention, where the overpressure channel 111 is a bore within the first piston 103. By placing the overpressure channel internally in the first piston 103, an opening of the overpressure channel may be arranged distant to the second spring 110. FIG. 4*b* shows a compensating device 20, wherein the overpressure channel has been arranged partly in the second piston 109 and partly in the first piston 103, and when the second spring 110 is adequately compressed, the overpressure channels are aligned and fluid is allowed to flow from one section 104, 105 of the chamber 101 to the other. FIG. 4*c* shows a compensating device 20, wherein the first piston has been arranged partly inside the second piston 109 and the overpressure channel has been arranged in the housing 100 of the compensating device 20. FIG. 4*d* shows a compensating device 20, wherein the first piston 103 has been arranged partly inside the second piston 109 and the overpressure channel has been arranged partly in the second piston 109 and partly in the first piston 103, and when the second spring 110 is adequately compressed, the overpressure channels are aligned and fluid is allowed to flow from one section 104, 105 of the chamber 101 to the other.

Figure 5:
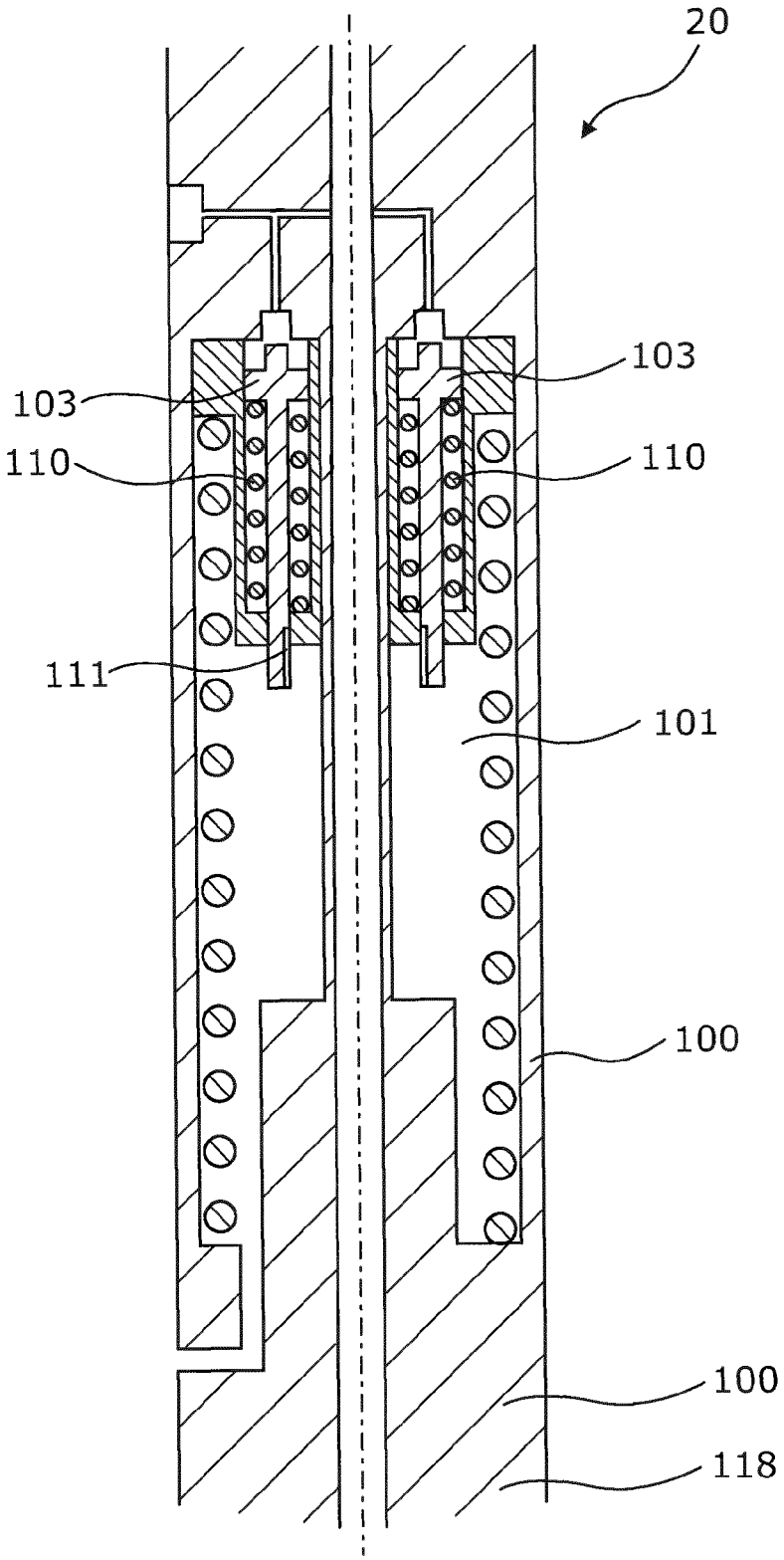
FIG. 5 shows a compensating device comprising non-coaxially arranged springs.

FIG. 5 shows a compensating device wherein two second springs 110 have been arranged non-coaxially with the centre axis of the tool for two second pistons 103 away from second end face 101*b* of the chamber 101.

Figure 6:
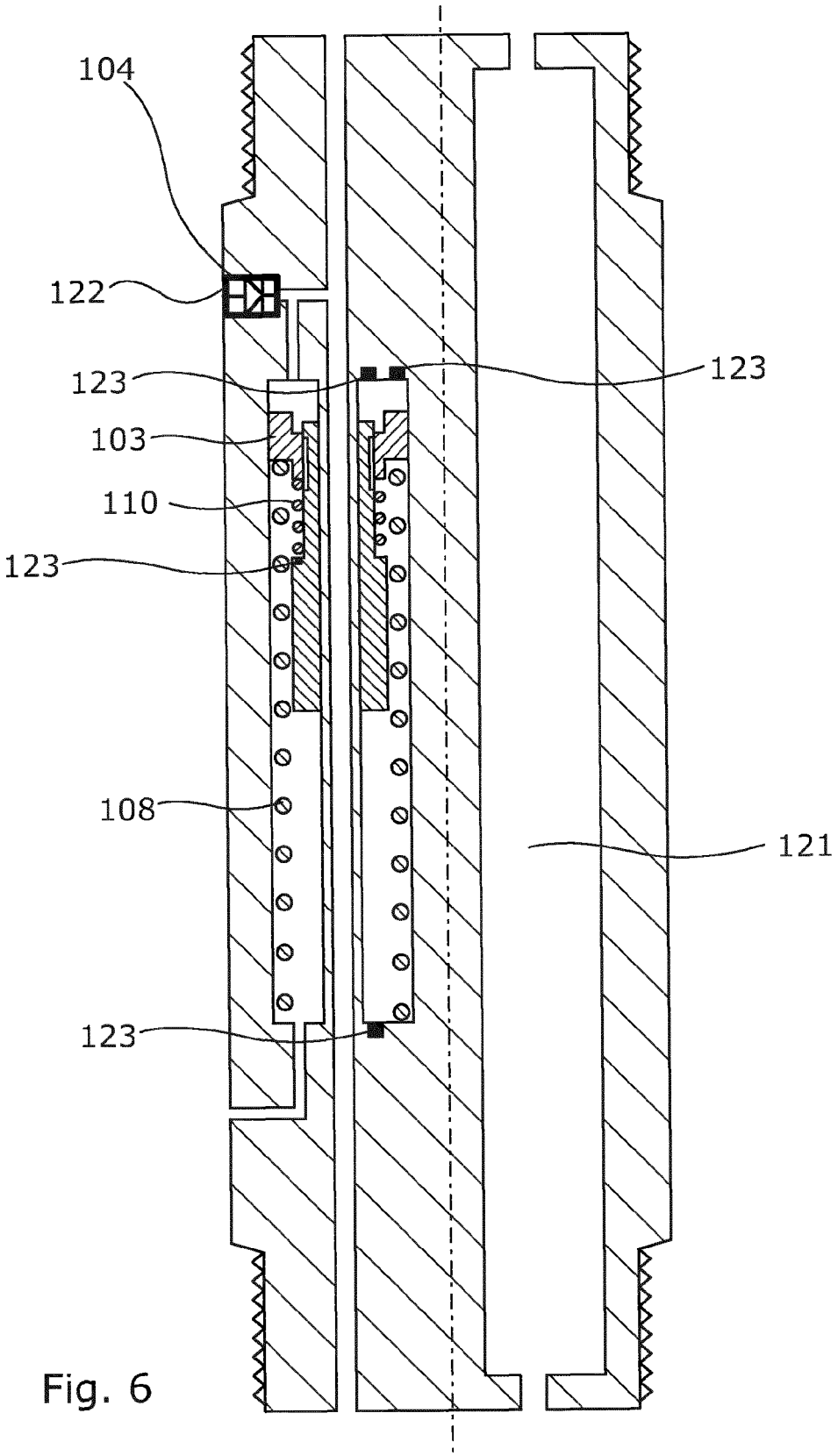
FIG. 6 shows a compensating device arranged non-coaxially with a centre axis of the tool.

FIG. 6 shows a compensating device 20 wherein the compensating device is arranged non-coaxially with the centre axis of the tool. In this way, the compensating device 20 may be arranged in parallel with another device, tool or, as shown in FIG. 6, an empty space 121. The freedom to arrange the compensating device non-coaxially from the centre axis increases the versatility of the compensating device in the design optimisation of space in the downhole tool string. In FIG. 6, the empty space 121 may provide a possibility to facilitate a hydraulic pressure fluid to pass a compensating device without entering neither the compensating chamber 101 nor the interior 113 of the hollow section 102. Furthermore, FIG. 6 shows an embodiment of a compensating device which comprises a plurality of first and/or second springs. Other embodiments may comprise a greater number of separate springs. The compensating device shown in FIG. 6 comprises a one-way valve 122 arranged in the first fluid port 106 and a set of switches 123 to enable a feedback signal to a control system, which allows the user to check when pistons and springs reach extremum positions during compression or decompression of the springs.

Figure 7:
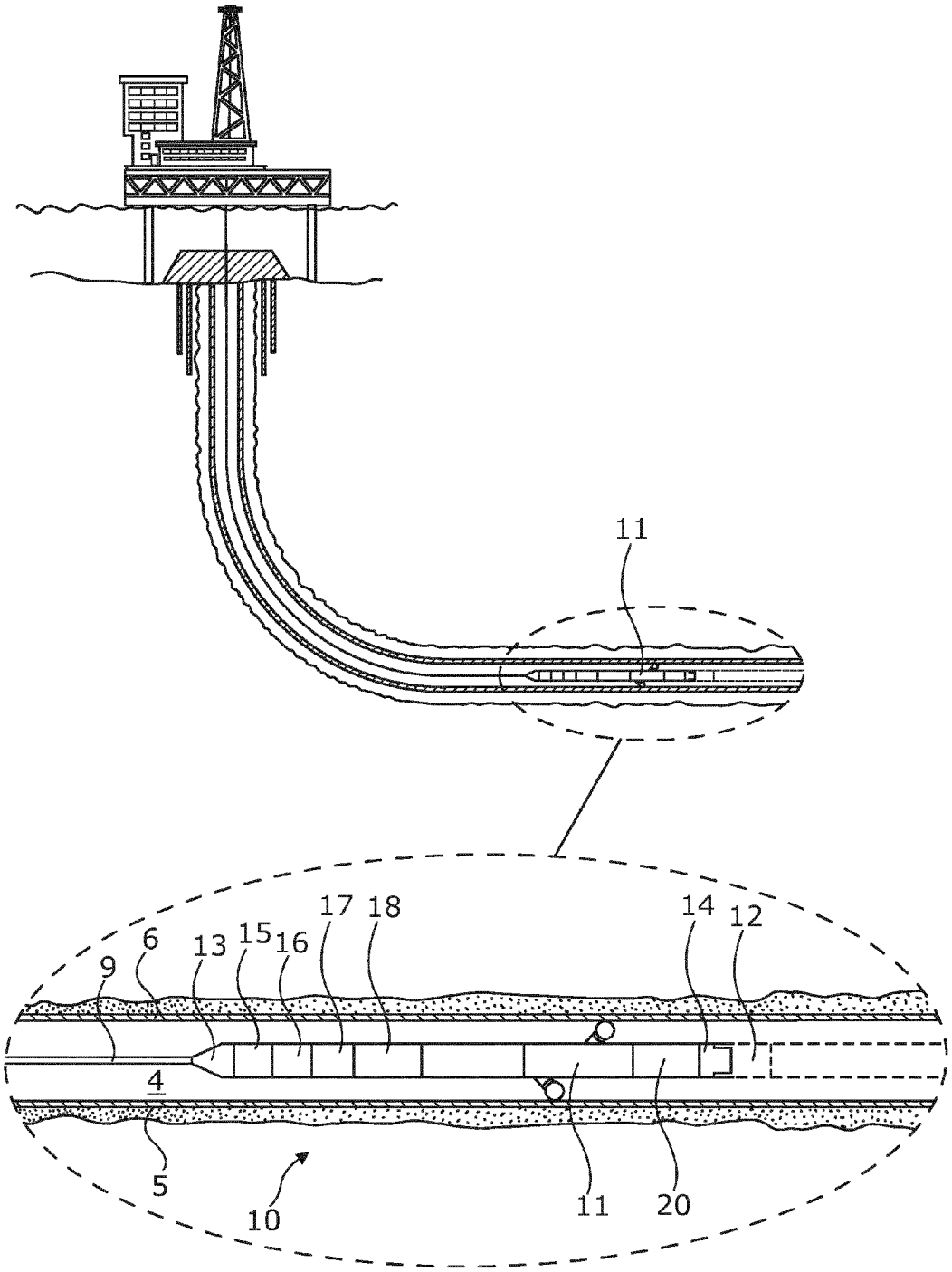
FIG. 7 shows a downhole system comprising a pressure compensating device.
Figure 8:
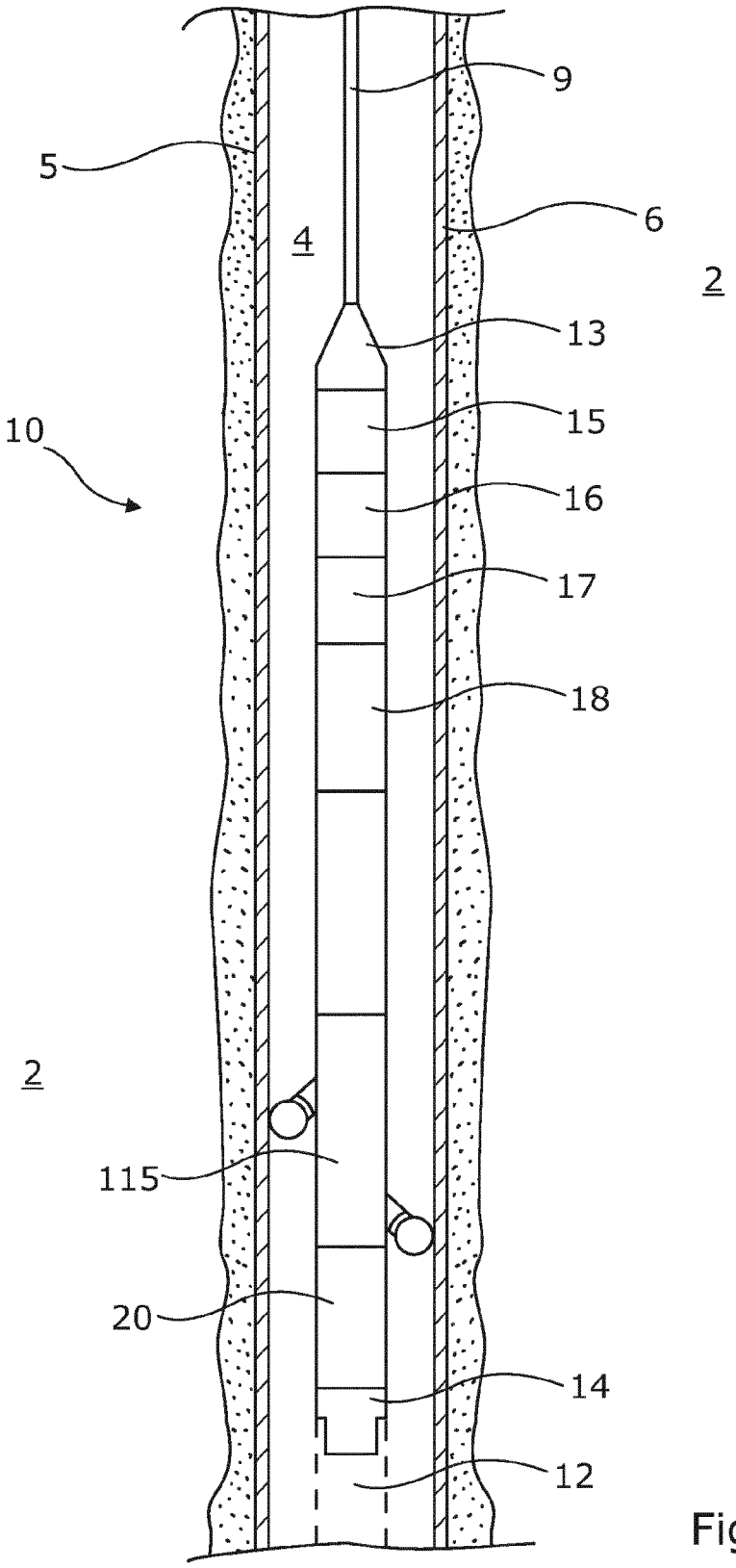
FIG. 8 shows a downhole tool string comprising a pressure compensating device.

When the compensating device is installed, it forms part of a downhole tool string 10 as shown in FIGS. 7 and 8. In FIGS. 7 and 8, the tool string may comprise driving units 11, compensating devices 20 and operational tools 12 etc. The tool string 10 comprises the tool 115, such as a driving unit 11, arranged in a casing 6, having an inside 4, in a well or borehole 5 in the formation 2. The downhole tool string 10 is powered through a wireline 9 which is connected with the tool via a top connector 13. The downhole tool further comprises an electronic section having mode shift electronics 15 and control electronics 16 before the electricity is supplied to an electrical motor 17 driving a hydraulic pump 18. The driving unit 11 may be connected with an operational tool 12 through a connecter 14.

Figure 9:
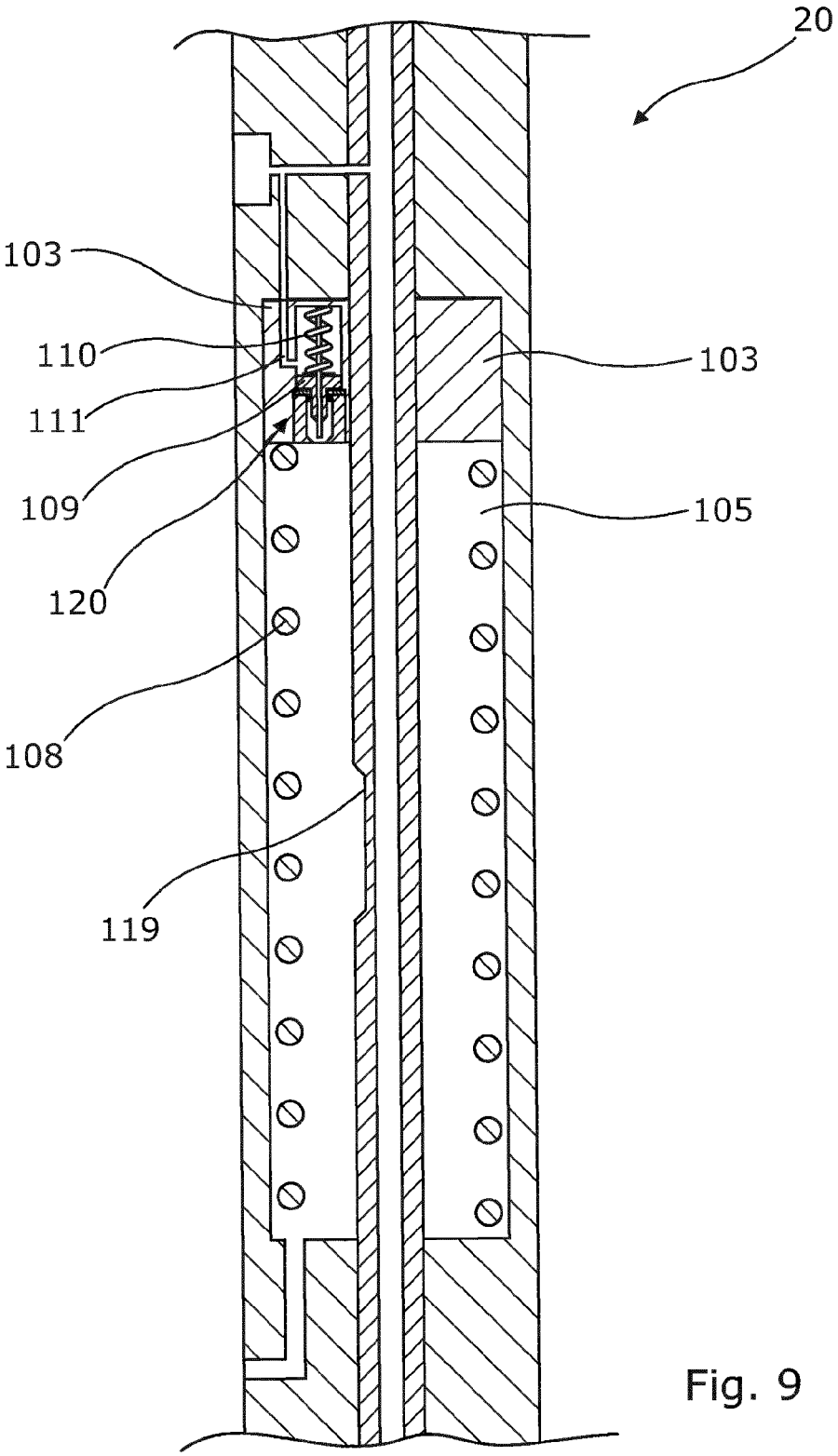
FIG. 9 shows a cut-through view of a pressure compensating device.
Figure 10:
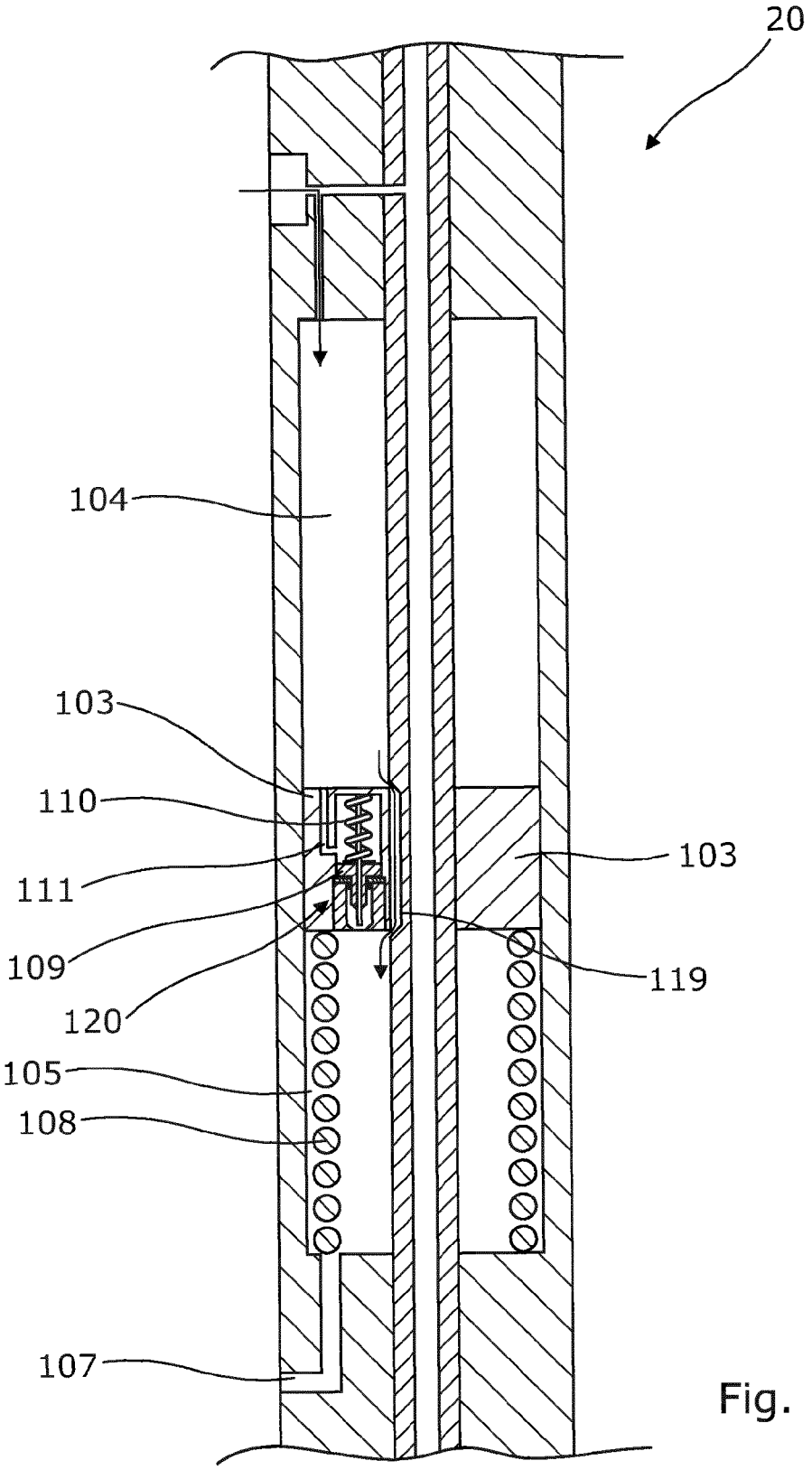
FIG. 10 shows a schematic diagram of a pressure compensating device during filling of a first section with hydraulic fluid.

As shown in FIGS. 9-10, the second spring 110 may be arranged within the first piston 103 in an overpressure valve 120, the overpressure valve comprising the second spring 110 and the second piston 109. Since a typical overpressure valve 120 only opens to flow in one direction, a recess 119 in the hollow section 102 may facilitate release of overpressure in the first section 104 as will be explained below. An overpressure channel 111 is arranged in the first piston to provide fluid connection between the first and second sections 104, 105 of the chamber 101, when the second pistons 109 are displaced towards maximum compression of the second spring 110.

FIG. 9 shows the first spring 108 in an uncompressed state such as before filling the compensating device. The first piston 103 is forced towards the end of the chamber 101 before filling the first section 104 with pressurised fluid as explained in FIG. 2*b*.

FIG. 10 shows the compensating device of FIG. 9 during filling of the first section 104 with pressurised fluid. When the first piston 103 reaches the position of the recess 119, the pressurised fluid is allowed to flow from the first section 104 into the second section 105, thus relieving the overpressure of the first section 104. When pressure is released to the second section 105, pressurised fluid will exit the second fluid port 107 and the user knows that the pressure in the first section 104 has reached a desired level.

Figure 11:
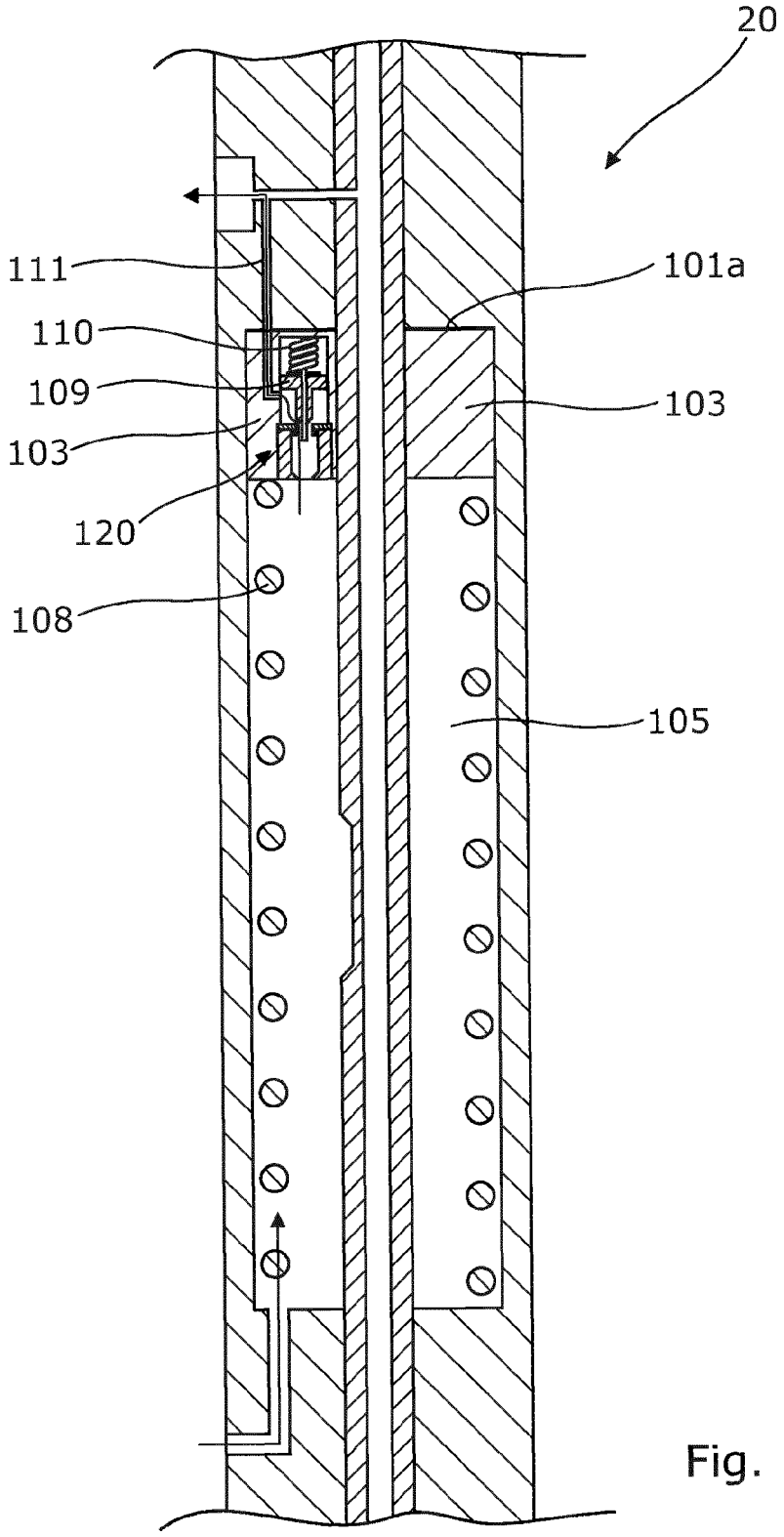
FIG. 11 shows a schematic diagram of a pressure compensating device during filling of a second section with borehole fluid.

In FIG. 11, the compensating device 20 of FIGS. 9 and 10 is shown during pressure build-up in the second section 105 when borehole fluid enters the second section 105 through the second fluid port 107 and the pressure in the second section 105 increases as the pressure in the borehole increases. In FIG. 11, the borehole pressure has forced the first pistons 103 towards the first end face 101*a* decompressing the first spring 108. By this movement of the first piston 103, the pressure is compensated, i.e. the pressure is equalised in the first and second sections of the pressure compensating device 20. Since the first section 104 is in fluid communication with the inside of a tool, the tool will, in this way, be pressure compensated and thereby not destroyed during a pressure build-up in the borehole. FIG. 11 shows the situation in which the first piston has reached its maximum displacement towards the first end face 101*a* and abuts the first end face 101*a* due to increasing pressure in the second section 105 stemming from the pressure in the borehole increasing. If the pressure continues to increase in the second section 105, the second piston 109 will begin to move towards the first end face and the second spring 110 will begin to compress. As shown, the overpressure in the second section 105 opens the fluid connection through the overpressure channel 111 between the first and second sections 104, 105 when the second piston 109 has moved sufficiently long towards the first end face 101*a*, which allows fluid from the second section 105 to enter the first section 104.

Figure 12:
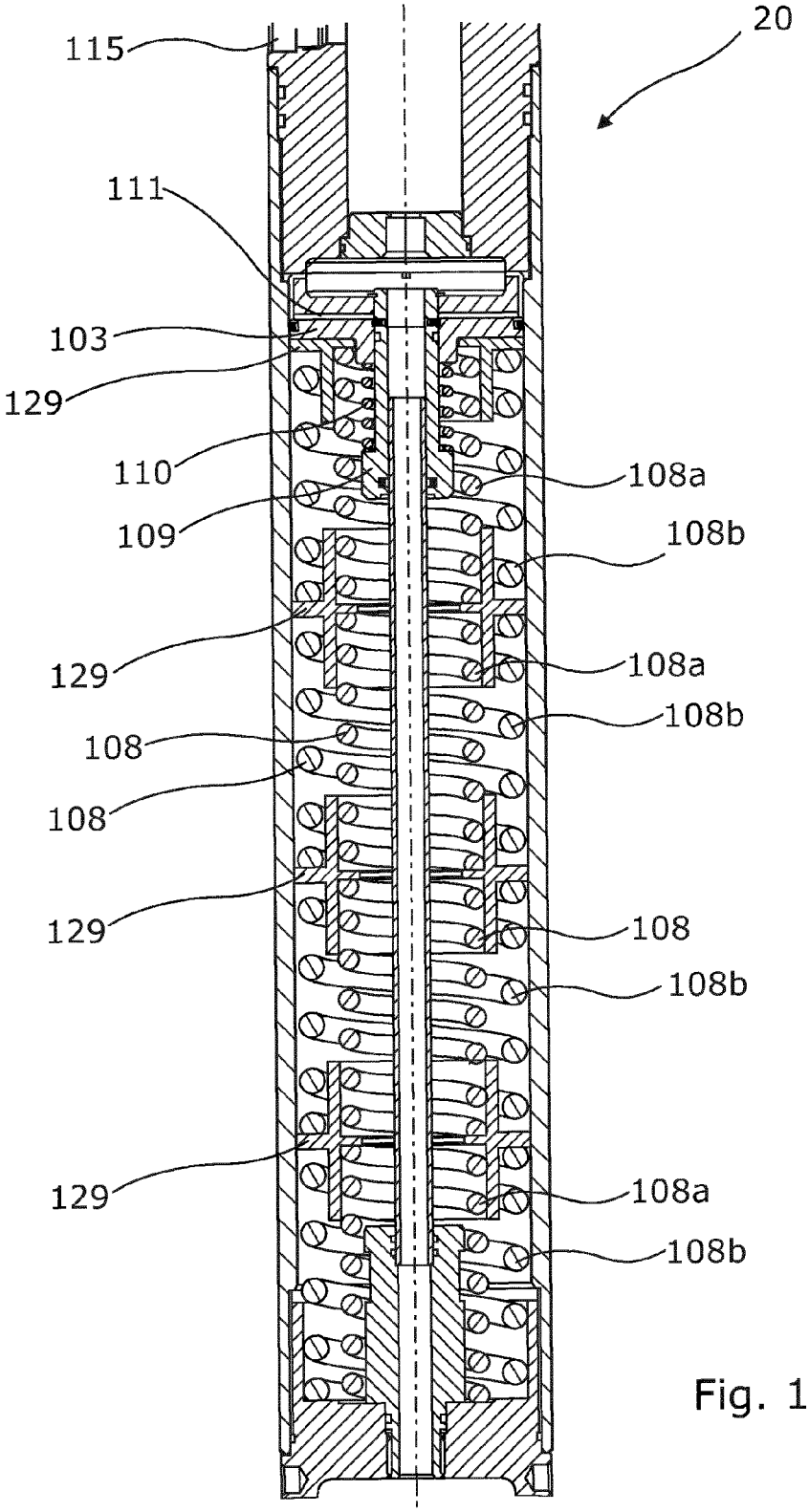
FIG. 12 shows a cut-through view of a pressure compensating device.

FIG. 12 shows another compensating device 20 comprising two rows of first springs 108 arranged concentrically in the compensating device 20. The first row of first springs 108*a* is arranged within the second row of first springs 108*b*. Each row of springs contains four separate springs, only separated by a number of spring guides 129. The number of spring guides 129 has been placed along the two first springs 108 to avoid undesired bending of the springs during compression which may lead to entangling of the two concentrically arranged rows of first springs 108.

In some embodiments of the invention, the spring may be of another type than the conventional coil spring shown in the figures. Such types may be helical spring type, bellow type, volute spring type, leaf spring type, gas spring type or disc spring type.

The first and second fluid ports may be controllably sealed off by a valve such as a ball valve, butterfly valve, choke valve, check valve or non-return valve, diaphragm valve, expansion valve, gate valve, globe valve, knife valve, needle valve, piston valve, pinch valve or plug valve.

Although the invention has been described in the above in connection with preferred embodiments of the invention, it will be evident for a person skilled in the art that several modifications are conceivable without departing from the invention as defined by the following claims.

The invention claimed is:

1. A downhole pressure compensating device for use in combination with a downhole tool, comprising:

a housing with a chamber and an internal hollow section, a first piston dividing the chamber into a first section and a second section, the first section being in fluid communication with a first fluid port, the second section being in fluid communication with a borehole through a second fluid port, and a first spring disposed within the second section to exert a pressure on the first piston to enable conservation of an overpressure in the first section, wherein the device further comprises:

a second piston, a second spring disposed between the first piston and the second piston, and an overpressure channel arranged in the first or the second piston, and in a compressed condition of the second spring, the overpressure channel, provides fluid communication between said first and second sections.

2. The downhole pressure compensating device according to claim 1 comprising at least a pressure connection to a mating tool in a tool string.

3. The downhole pressure compensating device according to claim 2 wherein the mating tool is a driving unit.

4. The downhole pressure compensating device according to claim 1 wherein the second section of the compensating device is in fluid communication with the inside of an electrical motor unit.

5. The downhole pressure compensating device according to claim 1, wherein the first spring, the second spring, the first piston and the second piston are arranged coaxially with the longitudinal centre axis of the compensating device.

6. The downhole pressure compensating device according to claim 1, wherein at least one of the first spring, the second spring, the first piston and the second piston has been arranged non-coaxially with the longitudinal centre axis of the compensating device non-circumscribing the internal hollow section.

7. The downhole pressure compensating device according to claim 6, wherein the compensating device is arranged non-coaxially with a longitudinal centre axis of the tool.

8. The downhole pressure compensating device according to claim 1, wherein the second piston is partly arranged inside the first piston.

9. The downhole pressure compensating device according to claim 1, wherein the first piston is partly arranged inside the second piston.

10. The downhole pressure compensating device according to claim 1, wherein the first section of the chamber is filled with a pressurized hydraulic fluid.

11. The downhole pressure compensating device according to claim 1, further comprising electrical sensors for monitoring a temperature inside the device.

12. The downhole pressure compensating device according to claim 1, further comprising at least a switch wherein the compensating device can be controlled by the at least a switch connected to a control system to adapt to changes in environmental conditions based on a feedback signal.

13. The downhole pressure compensating device according to claim 1, wherein the device comprises a plurality of first springs.

14. The downhole system comprising:

a wireline, a mating tool, and the downhole pressure compensating device according to claim 1.

15. The downhole system according to claim 14, wherein the mating tool is a driving unit or an operational tool.

16. A downhole tool system comprising:

at least a mating tool, and the downhole pressure compensating device according to claim 1.

17. The downhole tool system according to claim 16, wherein the mating tool is a driving unit or an operational tool.

18. The downhole pressure compensating device according to claim 1, wherein the second section of the compensating device is in fluid communication with the inside of a hydraulic pump unit.

19. The downhole pressure compensating device according to claim 1, further comprising electrical sensors to monitor pressures in the first and second sections or positions of the first and second pistons for producing a feedback signal to a control system.

* * * * *